United States Patent [19]

Papay et al.

[11] 4,331,545

[45] May 25, 1982

[54] LUBRICATING COMPOSITIONS CONTAINING BORONATED N-ALKANOL HYDROCARBYLAMIDE

[75] Inventors: Andrew G. Papay, Manchester; Joseph P. O'Brien, Kirkwood, both of Mo.

[73] Assignee: Edwin Cooper, Inc., St. Louis, Mo.

[21] Appl. No.: 191,694

[22] Filed: Sep. 29, 1980

Related U.S. Application Data

[63] Continuation-in-part of Ser. No. 31,621, Apr. 19, 1979, abandoned.

[51] Int. Cl.[3] ..... C10M 1/54

[52] U.S. Cl. ..... 252/49.6; 252/49.9; 260/404

[58] Field of Search ..... 252/49.6, 49.9; 260/404

[56] References Cited

U.S. PATENT DOCUMENTS

| | | | |
|---|---|---|---|
| 3,000,916 | 9/1961 | Klass et al. | 252/49.6 X |
| 3,009,791 | 11/1961 | Emrick | 252/49.6 X |
| 3,012,968 | 12/1961 | Emrick et al. | 252/49.6 |
| 3,169,148 | 2/1965 | Fein et al. | 44/76 X |
| 3,206,401 | 9/1965 | O'Halloran | 252/49.8 X |
| 3,254,025 | 5/1966 | Le Suer | 44/76 X |
| 4,097,389 | 6/1978 | Andress, Jr. | 252/49.6 X |
| 4,119,552 | 10/1978 | Davis et al. | 252/49.6 |

*Primary Examiner*—Andrew Metz

*Attorney, Agent, or Firm*—Donald L. Johnson; John F. Sieberth; Joseph D. Odenweller

[57] ABSTRACT

Friction of internal combustion engines is reduced by adding to the lubricating oil or fuel used in such engine a minor amount of a friction-reducing additive. The additive is the reaction product of a N-alkanol hydrocarbylamide such as N-ethanol oleamide with a boron compound such as boric acid.

12 Claims, No Drawings

LUBRICATING COMPOSITIONS CONTAINING BORONATED N-ALKANOL HYDROCARBYLAMIDE

PRIOR APPLICATIONS

This application is a continuation-in-part of application, Ser. No. 31,621, filed Apr. 19, 1979 and now abandoned.

BACKGROUND OF THE INVENTION

In order to conserve energy, automobiles are now being engineered to give improved gasoline mileage compared to those in recent years. This effort is of great urgency as a result of Federal regulations recently enacted which compel auto manufacturers to achieve prescribed gasoline mileage. These regulations are to conserve crude oil. In an effort to achieve the required mileage, new cars are being down-sized and made much lighter. However, there are limits in this approach beyond which the cars will not accommodate a typical family.

Another way to improve fuel mileage is to reduce engine friction. The present invention is concerned with this latter approach.

SUMMARY

According to the present invention, it has been discovered that engine friction can be lowered by using lubricating oil or fuel containing the reaction product of an N-alkanolhydrocarbylamide with a boron compound. The term "hydrocarbylamide" refers to an acylated amine.

DESCRIPTION OF THE PREFERRED EMBODIMENTS

A preferred embodiment of the invention is a friction-reducing additive effective in improving the fuel economy of internal combustion engines, said additive comprising the product obtained by the process comprising reacting a N-alkanol hydrocarbylamide having the structure:

$$R_1—CO—NR_2—R_3—OH$$

wherein $R_1$ is an aliphatic hydrocarbon group containing about 12–36 carbon atoms, $R_2$ is selected from the group consisting of hydrogen and lower alkyl and $R_3$ is a divalent hydrocarbon group containing 1–4 carbon atoms, with a boron compound selected from the group consisting of boric acid, esters of boric acid and mixtures of boric acid and alcohol wherein said alcohols are selected from the group consisting of monohydroxyalcohols containing 1 to about 20 carbon atoms, polyhydroxyalcohols containing 2 to about 6 carbon atoms and 2 to about 6 hydroxy groups and polyalkylene glycol containing 2 to about 10 alkyleneoxy groups.

In the above formula, $R_1$ can be any aliphatic hydrocarbon group including straight chain, branched chain, primary, secondary, tertiary, saturated or olefinically unsaturated groups. Representative examples of such groups are n-dodecyl, 2-ethyloctyl, 1-methylundecyl, 2-ethylhexadecyl, 1,1-dimethyloctadecyl, 4-methyltriacontyl, 1-hexyldodecyl, n-hexatriacontyl, n-dodecenyl, 1-methylheptadecenyl, n-heptadecenyl and the like.

$R_2$ can be hydrogen or a lower alkyl group. Preferred lower alkyls are those containing 1–4 carbon atoms such as methyl, ethyl, n-propyl, n-butyl, isobutyl and the like.

The N-alkanol hydrocarbylamides are readily made by reacting an aliphatic carboxylic acid, anhydride or ester with an N-alkanolamine under conventional acylation conditions to form the amide. Minor amounts of ester form which can be left in the reaction product.

The N-alkanol hydrocarbylamide is reacted with a boron compound. Suitable boron compounds include boric acid and esters of boric acid. When esters are used the lower alkyl esters are preferred such as trimethyl borate, triethyl borate, triisopropyl borate, triisobutyl borate, methyl diisopropyl borate and the like.

Optionally, alcohols and polyalkylene glycols can be included in the reaction. Monohydroxy alcohols containing 1–20 carbon atoms are useful. These include methanol, ethanol, n-propanol, isopropanol, isobutanol, tert-butanol, 2-ethyl hexanol and the like.

Polyhydric alcohols can also be used such as ethylene glycol, propylene glycol, glycerine, mannitol, sorbitol, sorbitan and the like. Useful polyalkylene glycols include diethylene glycol, triethylene glycol, hexaethylene glycol, decaethylene glycol, diethylene glycol, mixed ethylene glycol and the like.

The amount of alcohol or polyalkylene glycol used in the reaction is not critical. A useful range is about 1–50 parts by weight per part of boron compound.

The amount of boron compound reacted with the N-alkanol hydrocarbylamide can vary over a wide range. A useful amount is about 0.1–10 moles of boron compound per mole of N-alkanol hydrocarbylamide. A more preferred range is about 0.5–1.5 moles of boron compound per mole of amide.

The boron compound is added to the N-alkanol hydrocarbylamide and the mixture is stirred and heated to a temperature high enough to cause a reaction to occur introducing boron into the N-alkanol hydrocarbylamide. A useful temperature range is about 50°–250° C. Preferably, the reaction is conducted at temperatures that cause water or alkanol formed in the reaction to distill out. When alkanol or polyalkylene glycols are added to the reaction mixture, they are also preferably distilled out during the reaction of the boron compound. In a more preferred mode of operation the reactants are stirred at an elevated temperature without distillation for a period and then heated further to distillation condition. At the end of the reaction the mixture may be heated under vacuum to distill out any residual volatiles remaining. Following this, the mixture is preferably filtered.

The following example illustrates the method of making the present additive.

EXAMPLE 1

In a reaction vessel was placed 423 grams of oleic acid and 113.4 grams of ethanolamine. While stirring the mixture was heated to 165° C. while distilling out about 36 ml of water. It was then heated to 180° C. under vacuum to remove unreacted ethanolamine. The mixture was cooled and 187.2 grams of trimethyl borate was added dropwise at reflux (approximately 70° C.) over a 20 minute period. The mixture was refluxed an additional hour and then heated to distill out methanol yielding 651.5 grams of boronated N-ethanol oleamide.

Other reaction products described herein can be made following the above general procedure by substituting other carboxylic acids for oleic acid (e.g. stearic acid, tall oil acid) or by substituting other alkanolamine for the ethanol amine (e.g. isopropanolamine) or by using different boron compound (e.g. boric acid).

The additives are added to lubricating oil in an amount which reduces the friction of an engine operating with the oil in the crankcase. A useful concentration is about 0.05–3 wt %. A more preferred range is about 0.1–1.5 wt %.

From the above it can be seen that the present invention provides an improved crankcase lubricating oil. Accordingly, an embodiment of the invention is an improved motor oil composition formulated for use as a crankcase lubricant in an internal combustion engine wherein the improvement comprises including in the crankcase oil an amount sufficient to reduce fuel consumption of the engine of an oilsoluble reaction product of an N-alkanol hydrocarbylamide and a boron compound.

In a highly preferred embodiment such improved motor oil also contains an ashless dispersant, a zinc dialkyldithiophosphonate and an alkaline earth metal salt of a petroleum sulfonic acid or an alkaryl sulfonic acid (e.g. alkylbenzene sulfonic acid).

The additives can be used in mineral oil or in synthetic oils of viscosity suitable for use in the crankcase of an internal combustion engine. Crankcase lubricating oils have a viscosity up to about 80 SUS at 210° F. According to the present invention the additives function to increase fuel economy when added to lubricating oil compositions formulated for use in the crankcase of internal combustion engines. Similar mileage benefits could be obtained in both spark ignited and diesel engines.

Crankcase lubricating oils of the present invention have a viscosity up to about SAE 40. Sometimes such motor oils are given a classification at both 0° and 210° F., such as SAE 10W 40 or SAE 5W 30.

Crankcase lubricants of the present invention can be further identified since they usually contain a zinc dihydrocarbyl dithiophosphate in addition to the phosphonate additive. Likewise, these crankcase lubricants contain an alkaline earth metal sulfonate such as calcium petroleum sulfonate, calcium alkaryl sulfonate, magnesium petroleum sulfonate, magnesium alkaryl sulfonate, barium petroleum sulfonate, barium alkaryl sulfonate and the like.

Mineral oils include those of suitable viscosity refined from crude oil from all sources including Gulfcoast, midcontinent, Pennsylvania, California, Alaska and the like. Various standard refinery operations can be used in processing the mineral oil.

Synthetic oil includes both hydrocarbon synthetic oil and synthetic esters. Useful synthetic hydrocarbon oils include liquid polymers of $\alpha$-olefins having the proper viscosity. Especially useful are the hydrogenated liquid oligomers of $C_{6-12}$ $\alpha$-olefins such as $\alpha$-decene trimer. Likewise, alkylbenzenes of proper viscosity can be used, such as didodecylbenzene.

Useful synthetic esters include the esters of both monocarboxylic acid and polycarboxylic acid as well as monohydroxy alkanols and polyols. Typical examples are didodecyl adipate, trimethylol propane tripelargonate, pentaerythritol tetracaproate, di-(2-ethylhexyl)adipate, dilauryl sebacate and the like. Complex esters prepared from mixtures of mono- and dicarboxylic acid and mono- and polyhydroxyl alkanols can also be used.

Blends of mineral oil with synthetic oil are particularly useful. For example, blends of 10–25 wt % hydrogenated $\alpha$-decene trimer with 75–90 wt % 150 SUS (100° F.) mineral oil results in an excellent lubricant. Likewise, blends of about 10–25 wt % di-(2-ethylhexyl-)adipate with mineral oil of proper viscosity results in a superior lubricating oil. Also blends of synthetic hydrocarbon oil with synthetic esters can be used. Blends of mineral oil with synthetic oil are especially useful when preparing low viscosity oil (e.g. SAE 5W 20) since they permit these low viscosities without contributing excessive volatility.

The more preferred lubricating oil composition includes zinc dihydrocarbyldithiophosphate (ZDDP) in combination with the present additives. Both zinc dialkyldithiophosphates and zinc dialkaryldithiophosphates as well as mixed alkyl-aryl ZDDP are useful. A typical alkyl-type ZDDP contains a mixture of isobutyl and isoamyl groups. Zinc dinonylphenyldithiophosphate is a typical aryl-type ZDDP. Good results are achieved using sufficient ZDDP to provide about 0.01–0.5 weight percent zinc. A preferred concentration supplies about 0.05–0.3 weight percent zinc.

Another additive used in the oil compositions are the alkaline earth metal petroleum sulfonates or alkaline earth metal alkaryl sulfonates. Examples of these are calcium petroleum sulfonates, magnesium petroleum sulfonates, barium alkaryl sulfonates, calcium alkaryl sulfonates or magnesium alkaryl sulfonates. Both the neutral and the overbased sulfonates having base numbers up to about 400 can be beneficially used. These are used in an amount to provide about 0.05–1.5 wt % alkaline earth metal and more preferably about 0.1–1.0 wt %. In a most preferred embodiment the lubricating oil composition contains a calcium petroleum sulfonate or alkaryl (e.g. alkylbenzene) sulfonate.

Viscosity index improvers can be included such as the polyalkylmethacrylate type or the ethylene-propylene copolymer type. Likewise, styrene-diene VI improvers or styrene-acrylate copolymers can be used. Alkaline earth metal salts of phosphosulfurized polyisobutylene are useful.

Most preferred crankcase oils also contain an ashless dispersant such as the polyolefin-substituted succinamides and succinimides of polyethylene polyamines such as tetraethylenepentamine. The polyolefin succinic substituent is preferably a polyisobutene group having a molecular weight of from about 800 to 5,000. Such ashless dispersants are more fully described in U.S. Pat. Nos. 3,172,892 and 3,219,666 incorporated herein by reference.

Another useful class of ashless dispersants are the polyolefin succinic esters of mono- and polyhydroxy alcohols containing 1 to about 40 carbon atoms. Such dispersants are described in U.S. Pat. Nos. 3,381,022 and 3,522,179.

Likewise, mixed ester/amides of polyolefin substituted succinic acid made using alkanols, amines and/or aminoalkanols represent a useful class of ashless dispersants.

The succinic amide, imide and/or ester type ashless dispersants may be boronated by reaction with a boron compound such as boric acid. Likewise the succinic amide, imide, and/or ester may be oxyalkylated by reaction with an alkylene oxide such as ethylene oxide or propylene oxide.

Other useful ashless dispersants include the Mannich condensation products of polyolefin-substituted phenols, formaldehyde and polyethylene polyamine. Preferably, the polyolefin phenol is a polyisobutylene-substituted phenol in which the polyisobutylene group has a molecular weight of from about 800 to 5,000. The preferred polyethylene polyamine is tetraethylene pentamine. Such Mannich ashless dispersants are more fully described in U.S. Pat. Nos. 3,368,972; 3,413,347; 3,442,808; 3,448,047; 3,539,633; 3,591,598; 3,600,372; 3,634,515; 3,697,574; 3,703,536; 3,704,308; 3,725,480; 3,726,882; 3,736,357; 3,751,365; 3,756,953; 3,793,202; 3,798,165; 3,798,247 and 3,803,039.

The above Mannich dispersants can be reacted with boric acid to form boronated dispersants having improved corrosion properties.

Superior results are obtained by using the aliphatic borated N-alkyl hydrocarbylamides in lubricating oil in combination with a phosphonate additive. Preferred phosphonates are the di-$C_{1-4}$ alkyl, $C_{12-36}$ alkyl or alkenyl phosphonates. These compounds have the structure:

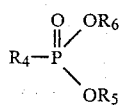

wherein $R_4$ is an aliphatic hydrocarbon group containing about 12–36 carbon atoms and $R_5$ and $R_6$ are independently selected from lower alkyl groups containing about 1–4 carbon atoms. Representative examples of these synergistic coadditives are:

dimethyl octadecylphosphonate
dimethyl octadecenylphosphonate
diethyl 2-ethyldecylphosphonate
ethyl propyl 1-butylhexadecylphosphonate
methyl ethyl octadecylphosphonate
methyl butyl eicosylphosphonate
dimethyl hexatriacontylphosphonate When using the phosphonate coadditive only a small synergistic amount is required. A useful range is about 0.005–0.75 wt % based on the formulated oil. A more preferred amount is about 0.05–0.5 wt %.

The friction reducing additives of this invention are also useful in liquid hydrocarbon fuel compositions. Fuel injected or inducted into a combustion chamber wets the walls of the cylinder. Fuels containing a small amount of the present additive reduce the friction due to the piston rings sliding against the cylinder wall.

The additives can be used in both diesel fuel and gasoline used to operate internal combustion engines. Fuels containing about 0.001–0.25 wt % of the present additives can be used.

Fuels used with the invention can contain any of the additives conventionally added to such fuels. In the case of gasoline it can include dyes, antioxidants, detergents, antiknocks (e.g. tetraethyllead, methylcyclopentadienylmanganese tricarbonyl, rare earth metal chelates, methyl tert-butylether and the like). In the case of diesel fuels the compositions can include pour point depressants, detergents, ignition improvers (e.g. hexylnitrate) and the like.

Tests were conducted which demonstrated the friction reducing properties of the present invention.

LFW-1 Test

In this test a metal cylinder is rotated around its axis 45° in one direction and then 45° in the opposite direction at a rate of 120 cycles per minute. A metal block curved to conform to the circular contour of the cylinder presses at a fixed load against the periphery of the cylinder. Test lubricant is applied to the rubbing surface between the cylinder and the block. Torque transmitted to the block from the oscillating cylinder is measured. The greater the torque the greater the friction. Results are given in terms of "percent improvement" which is the percent reduction in torque compared to that obtained with the test oil without the test additive.

SAE-2 Fly Wheel Test

In this test a heavy fly wheel is rotated at 1,440 rpm. A series of 9 clutch plates are then brought to bear axially at a defined load against the fly wheel. The fly wheel is connected to the rotating plates. The stationary plates are connected to a device which measures rotational torque. The time from initially applying pressure through the clutch plates until the rotating plates cease to rotate is measured. Also, the rotational torque measured at the stationary plates is plotted against time. Torque rises initially to a value referred to as "dynamic torque" and then rises finally to a value called "static torque." The clutch plates are immersed in test lubricant. A reduction in friction is indicated by (1) an increase in time required to transmit rotation to the outermost plate and (2) a decrease in dynamic and static torque. Results are reported in percent time increase (percent improvement) and percent reduction in torque compared to that obtained using the same oil without the test additive.

The test oil is a fully formulated oil of SAE SE quality. Test results are given in the following table:

| | % Improvement | | | |
|---|---|---|---|---|
| | | SAE-2 | | |
| | | | Torque | |
| Additive | LFW-1 | Time | Dynamic | Static |
| Example 1 (0.3 wt %) | 4 | 7 | 8 | 27 |
| Example 1 (0.3 wt %) plus 0.2 wt % octadecylphosphonate | 7 | 12 | 12 | 46 |

As the above test shows, the additives of this invention are very effective in reducing friction. Furthermore, their effectiveness is improved by using them in combination with a phosphonate.

Emerick in U.S. Pat. No. 3,009,791 discloses certain boronated amides of amines having the structure.

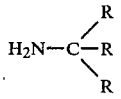

wherein one or more of the R groups are alkanol radicals. Typical products are made from oleic acid and 2-amino-2-methyl propane diol-1,3 (Emerick Ex. 1) and oleic acid and 2-amino-2,2-dimethyl propanol (Emerick Ex. 3). The Emerick products are used in fuel and lubricating compositions to prevent deposits in engine combustion chambers, prevent engine surface ignition, prevent carburetor deposits and to prevent rust. They are not taught as friction reducers.

The Emerick products of Examples 1 and 3 were made and compared to the boronated amides made from monoethanol amine as claimed in this application.

EXAMPLE 2

This example is for comparative purposes and describes the preparation of the product in Emerick, Example 1.

In a reaction vessel was placed 21 g. 2-amino-2-methyl-1,3-propanediol, 56.5 g. oleic acid and 100 ml. toluene. The mixture was heated to reflux and water was removed using a Dean Stark trap. The water removal was continued for 10 hours. Then 12.4 g. of boric acid was added. The mixture was stirred and refluxed while removing water. A total of 6 ml. of water was removed over a 4 hour period. The product was filtered and solvent removed by distillation leaving a residual product.

EXAMPLE 3

This example is for comparative purposes and describes the preparation of the product in Emerick, Example 3.

In a reaction vessel was placed 26.7 g. of 2-amino-2-methyl-1-propanol, 84.6 g. oleic acid and 200 ml. toluene. The mixture was heated to reflux and water was removed using a Dean Stark water trap. Water removal was continued for 15 hours to remove 4.9 ml. Then 5.6 g. of boric acid was added and reflux water removal continued for 5 hours and 20 minutes. A small amount of silicone was required to stop foaming. A total of 5 ml. of water was removed. The toluene was then distilled out leaving the product as this residue.

EXAMPLE 4

This example is a preparation of a boronated oleamide of a hydroxyethyl amine of the present invention made following the Emerick procedure.

In a reaction vessel was placed 56.4 g. of oleic acid, 12.2 g. of monoethanol amine and 150 ml. toluene. The mixture was heated to reflux and water was removed using a Dean Stark water trap. A drop of silicone was added to stop foaming. About 2.6 ml. of water was collected but many water drops were sticking to the side of the apparatus. Vacuum was then applied and toluene distilled out.

The product was dissolved in 150 ml. toluene and 12.4 g. of boric acid was added. The mixture was refluxed to remove water using a Dean Stark water trap. A few drops of silicone fluid were required to stop foaming. A total of 3.8 ml. of water was removed. The product was distilled to remove toluene leaving a waxy residual product.

The product made in Examples 2–4 were subjected to the previously described LFW-1 friction test with the following results.

| Additive | Percent Improvement |
|---|---|
| Example 2 | 1.9 |
| Example 3 | 1.3 |
| Example 4 | 4.0 |

As these results show, the products of this invention are much better friction reducers compared to the additives in U.S. Pat. No. 3,009,791.

We claim:

1. A friction-reducing additive effective in reducing friction in internal combustion engines, said additive comprising the product obtained by the process comprising reacting a N-alkanol hydrocarbylamide having the structure:

$$R_1—CO—NR_2—R_3—OH$$

wherein $R_1$ is an aliphatic hydrocarbon group containing about 12–36 carbon atoms, $R_2$ is selected from the group consisting of hydrogen and lower alkyl and $R_3$ is a divalent hydrocarbon group containing 2 carbon atoms, with a boron compound selected from the group consisting of boric acid, esters of boric acid and mixtures of boric acid and alcohol wherein said alcohols are selected from the group consisting of monohydroxy alcohols containing 1 to about 20 carbon atoms, polyhydroxy alcohols containing 2 to about 6 carbon atoms and 2 to about 6 hydroxy groups and polyalkylene glycol containing 2 to about 10 alkyleneoxy groups.

2. An additive of claim 1 wherein $R_2$ is hydrogen.

3. An additive of claim 2 wherein $R_1$—CO— is derived from oleic acid such that the additive is the reaction product of N-ethanol oleamide with said boron compound.

4. An additive of claim 3 wherein said boron compound is boric acid or a lower alkyl ester thereof.

5. Lubricating oil suitable for use in the crankcase of internal combustion engines containing a friction-reducing amount of an oil-soluble product obtained by the process comprising reacting a N-alkanol hydrocarbylamide having the structure:

$$R_1—CO—NR_2—R_3—OH$$

wherein $R_1$ is an aliphatic hydrocarbon group containing about 12–36 carbon atoms, $R_2$ is selected from the group consisting of hydrogen and lower alkyl and $R_3$ is a divalent hydrocarbon group containing 2 carbon atoms, with a boron compound selected from the group consisting of boric acid, esters of boric acid and mixtures of boric acid and alcohol wherein said alcohols are selected from the group consisting of monohydroxy alcohols containing 1 to about 20 carbon atoms, polyhydroxy alcohols containing 2 to about 6 carbon atoms and 2 to about 6 hydroxy groups and polyalkylene glycol containing 2 to about 10 alkyleneoxy groups.

6. A lubricating oil composition of claim 5 wherein $R_2$ is hydrogen.

7. A lubricating oil composition of claim 6 wherein the group $R_1$—CO— is derived from oleic acid such that said product is the reaction product of N-ethanol oleamide with said boron compound.

8. A lubricating oil composition of claim 7 wherein said boron compound is boric acid or a lower alkyl ester thereof.

9. A lubricating oil composition of claim 5 further containing a minor amount sufficient to further reduce friction of a di-$C_{1-4}$ alkyl $C_{12-36}$ hydrocarbylphosphonate.

10. A lubricating oil composition of claim 9 wherein said phosphonate is dimethyl $C_{12-36}$ hydrocarbylphosphonate.

11. A lubricating oil composition of claim 10 wherein said oilsoluble product is the reaction product of N-ethanol oleamide with said boron compound.

12. A lubricating oil composition of claim 11 wherein said phosphonate is dimethyl octadecylphosphonate.

* * * * *